United States Patent [19]

McElmurry et al.

[11] Patent Number: 4,625,347

[45] Date of Patent: Dec. 2, 1986

[54] ROLLOVER BACK SOFA-BED

[75] Inventors: Terry J. McElmurry; H. Coleman Davis; William B. Leftwich, all of Elkhart, Ind.; David Markel, White Pigeon, Mich.

[73] Assignee: Coachmen Industries, Inc., Middlebury, Ind.

[21] Appl. No.: 642,765

[22] Filed: Aug. 21, 1984

[51] Int. Cl.[4] ..... A47C 23/00

[52] U.S. Cl. ..... 5/43; 5/45; 5/52

[58] Field of Search ..... 5/43, 45, 52; 297/115–117

[56] References Cited

U.S. PATENT DOCUMENTS

| | | | |
|---|---|---|---|
| 1,336,062 | 4/1920 | Arton | 5/52 |
| 2,798,231 | 7/1957 | Bebry et al. | 5/52 |
| 2,999,250 | 9/1961 | Rea | 5/52 |
| 3,077,611 | 2/1963 | Laemmle | 5/52 |
| 4,110,855 | 9/1978 | Acker | 5/45 |

*Primary Examiner*—Gary L. Smith
*Assistant Examiner*—Michael F. Trettel
*Attorney, Agent, or Firm*—Thomas J. Dodd

[57] ABSTRACT

A convertible rollover back sofa-bed which includes a wedge member associated with its pivoting linkage system which allows the sofa-bed to swing outwardly as the back of the sofa-bed is pivoted from its sofa position into its bed position.

4 Claims, 8 Drawing Figures

ROLLOVER BACK SOFA-BED

SUMMARY OF THE INVENTION

This invention relates to a convertible sofa-bed and will have special application to a rollover back sofa bed usable in campers and mobile homes.

Convertible sofa-beds have been used in recreational vehicles for many years. One of the most popular of these beds has been the rollover-back type illustrated in the Mizelle U.S. Pat. No. 3,800,337. These type beds are extremely versatile in restricted space areas with one major disadvantage, that is, due to the desirable snug fit between the arms and back rest, rollover movement was somewhat inhibited.

The sofa-bed of this invention includes a wedge member associated with the base frame and the arms of the bed. As the sofa back rest is rotated into its bed position, the wedge member disengages from the arm linkage to allow the arms to tilt outwardly. As the back is pivoted into the sofa position, the arm linkage engages the wedge member and pivots the arms into a snug fit with the seat and back rest.

Accordingly, it is an object of this invention to provide for an improved rollover back sofa-bed.

Another object of this invention is to provide for a rollover back sofa-bed which allows efficient rotation of the back rest into a bed position.

Another object of this invention is to provide for a rollover back sofa-bed which is aesthetically pleasing.

Still another object of this invention is to provide for a rollover back sofa-bed which is economical.

Other objects of this invention will become apparent upon reading the following description.

BRIEF DESCRIPTION OF THE DRAWINGS

A preferred embodiment of the invention has been chosen for purposes of illustration wherein.

DESCRIPTION OF THE PREFERRED EMBODIMENT

Figure 1:
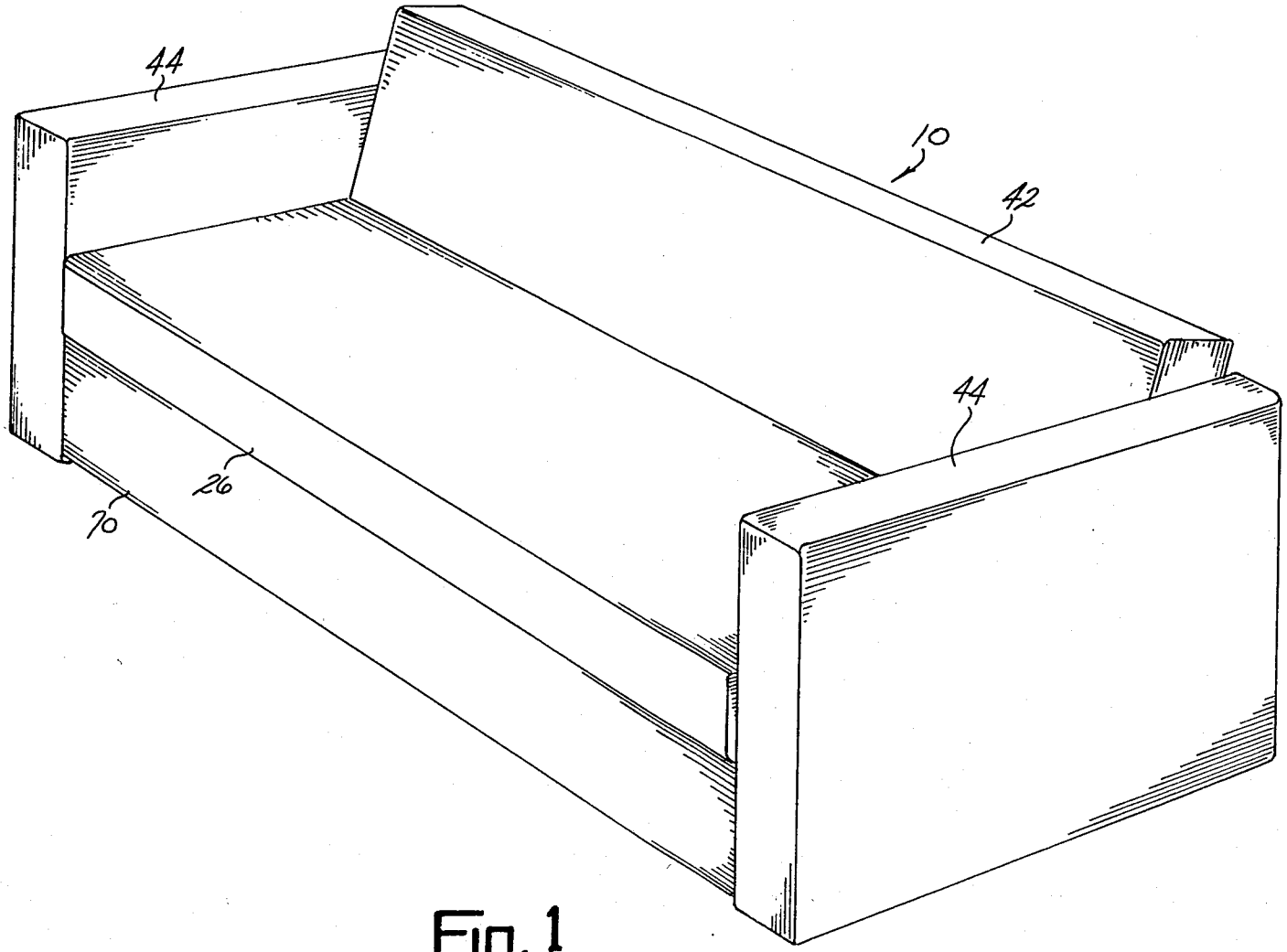
FIG. 1 is a perspective view of the rollover back sofa-bed shown in its sofa or sitting position.

The preferred embodiment herein described is not intended to be exhaustive or to limit the invention to the precise form disclosed. It is chosen and described to explain the principles of the invention and its application and practical use to enable others skilled in the art to utilize the invention.

The convertible sofa-bed 10 shown in the drawing is generally adapted for use in campers and mobile homes. Sofa-bed 10 includes a base frame 12 formed of spaced U-shaped end members 14. End members 14 are connected by longitudinal members 16 which extend the length of the sofa-bed. Each end member 14 includes upright vertical legs 13. The connecting linkage extending from each end member 14 is the same and thus only one complete end member is shown and will be described. Connected to the top of each end member 14 is an L-bracket 20. A seat cushion 26 is pivotally connected by a hinge 24 to the rear cross member 16 and spans the cross members, extending from one L-bracket 20 to the other.

A link 28 is pivotally connected at 30 to L-bracket 20 and is connected to a back support 32 at pivot 34. A link 36 is pivotally connected at 38 to L-bracket 20 and is connected to back support 32 at pivot 40. A back cushion 42 is attached to back support 32, extending generally the length of seat cushion 26. Links 28,36 are positioned so as to allow approximately 270°–285° rollover movement of back support 32 and associated back cushion 42 relative to seat cushion 26. The construction of sofa-bed 10 as thus far described corresponds generally to the construction embodied in U.S. Pat. No. 3,800,337, incorporated herein by reference.

Sofa-bed 10 also includes a pair of arms 44 which are each connected at 46 to an end member 14. Each arm 44 includes an interior channel part 48. A pivot member 50 is pivotally connected at 52 to L-bracket 20 below pivot 30 of link 28. A rod 54 is connected to pivot member 50 at one end 56. Rod 54 extends through a bore 60 in L-bracket 20 and into arm channel part 48 where it terminates in an upturned end 58 behind a stop plate 59. Stop plate 59 is attached to arm 44 and retains rod end 58 in arm channel part 48. A wedge member 62 is fixedly connected to pivot member 50 at a location spaced from pivot 52 and extends angularly outwardly towards arm 44. A link 64 is fixedly connected to link 28 at its pivot 30 and extends at an angle from link 28. A stop 66 is connected to L-bracket 20 to limit pivoting movement of links 28 and 36 and connected back support 32 and back cushion 42.

Figure 2:
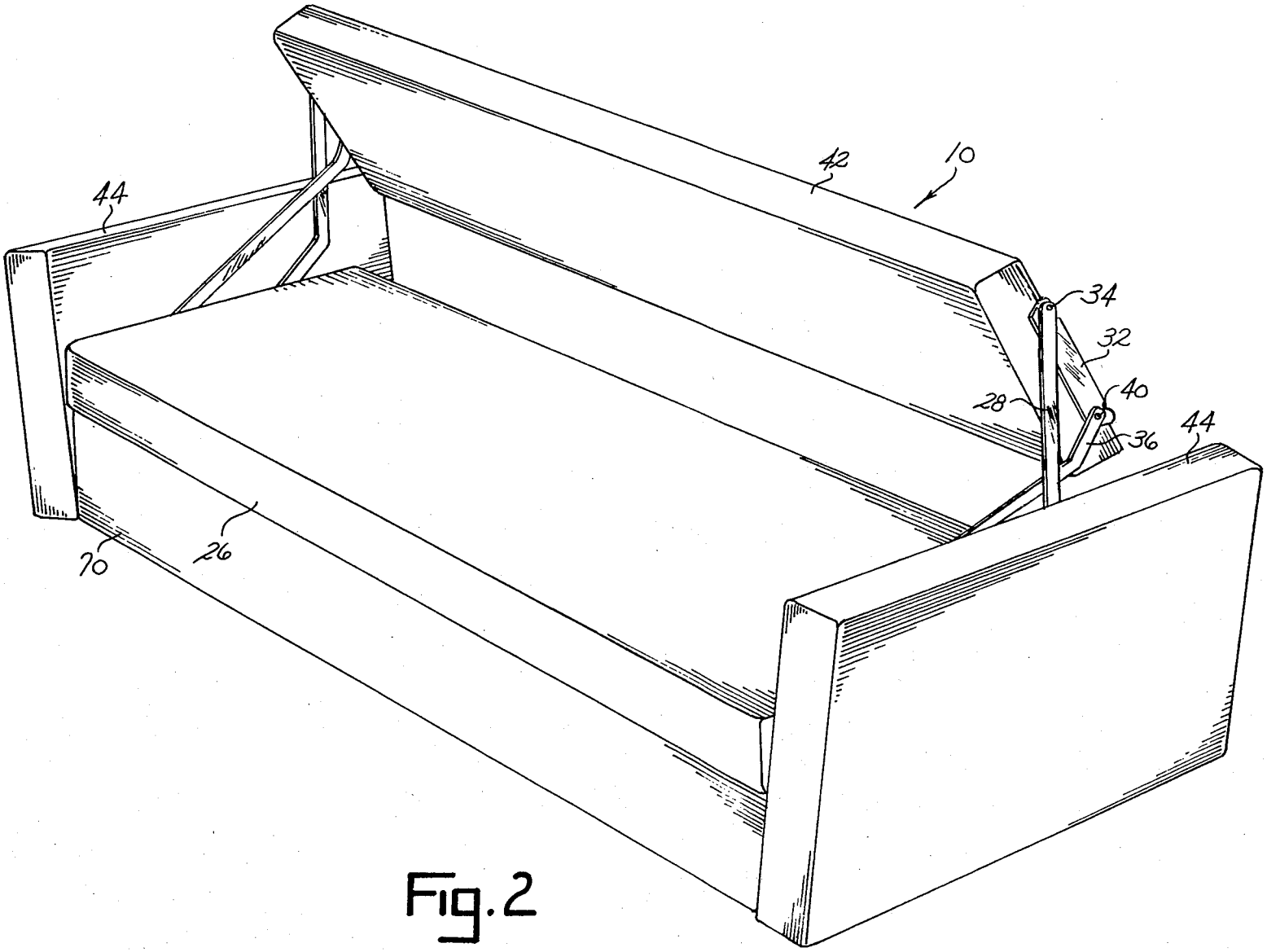
FIG. 2 is a perspective view of the sofa-bed in an intermediate position.
Figure 3:
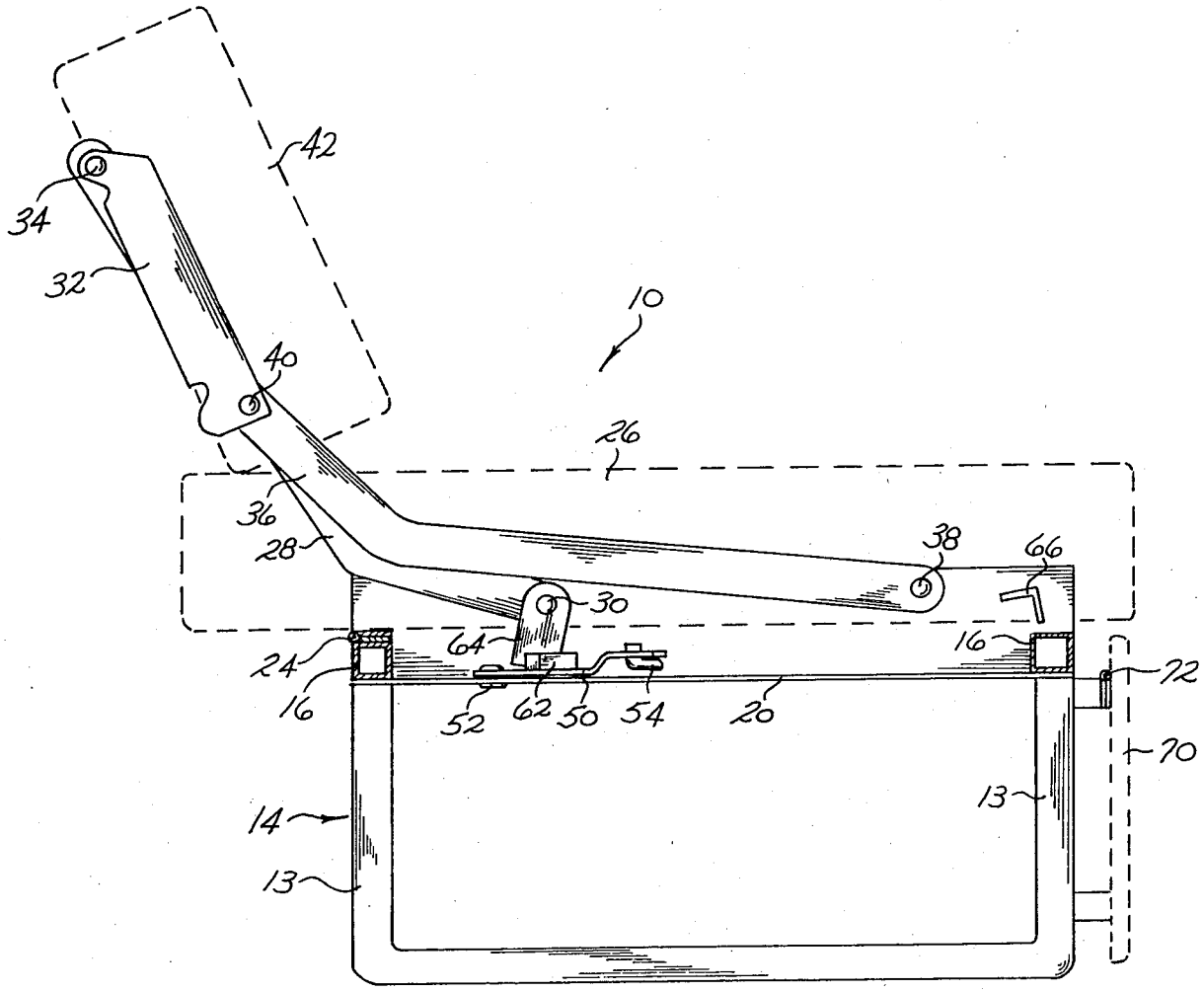
FIG. 3 is a sectional view depicting the linkage mechanism with the sofa-bed in its sofa position and the cushions in broken lines for illustrative purposes.
Figure 4:
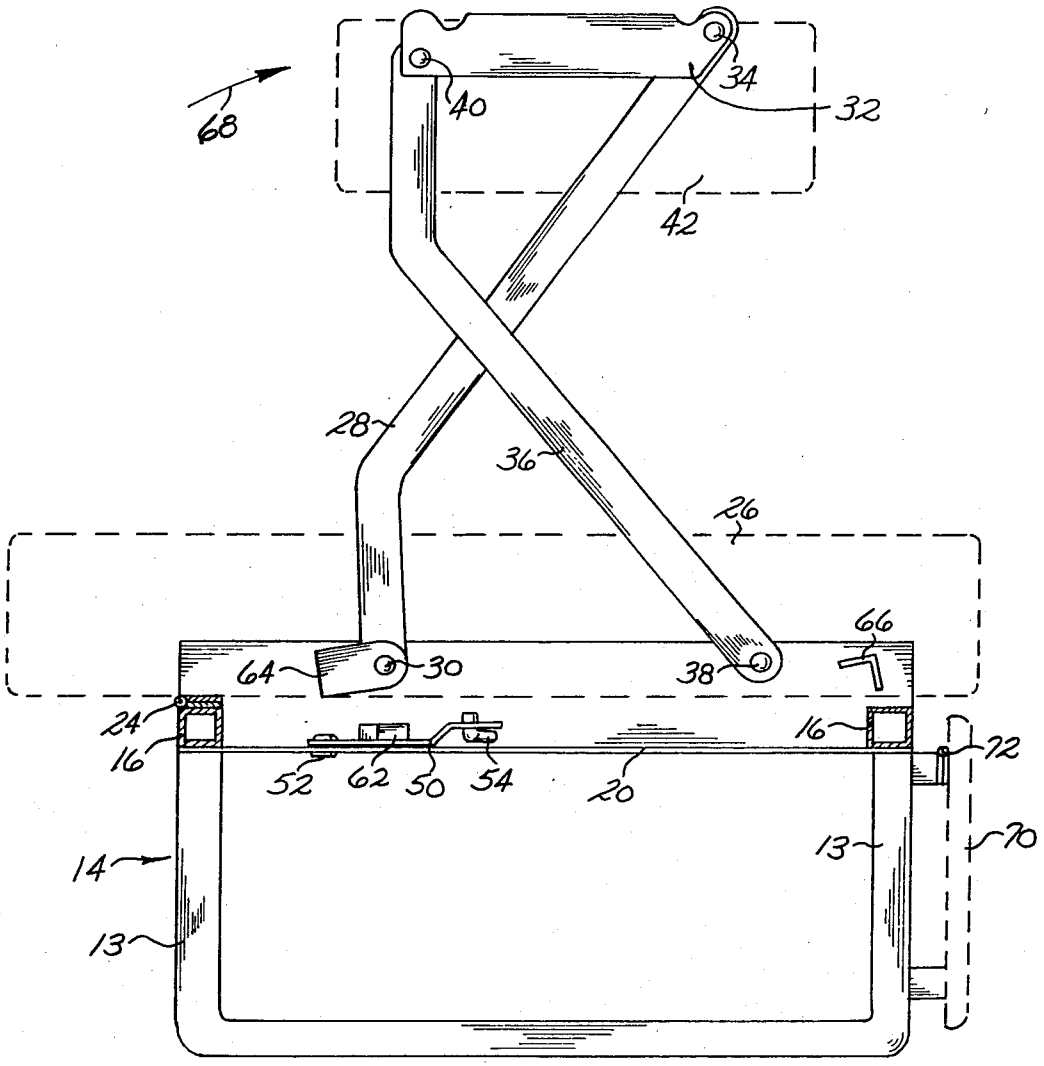
FIG. 4 is a sectional view similar to FIG. 3, but showing the sofa-bed in an intermediate position.
Figure 5:
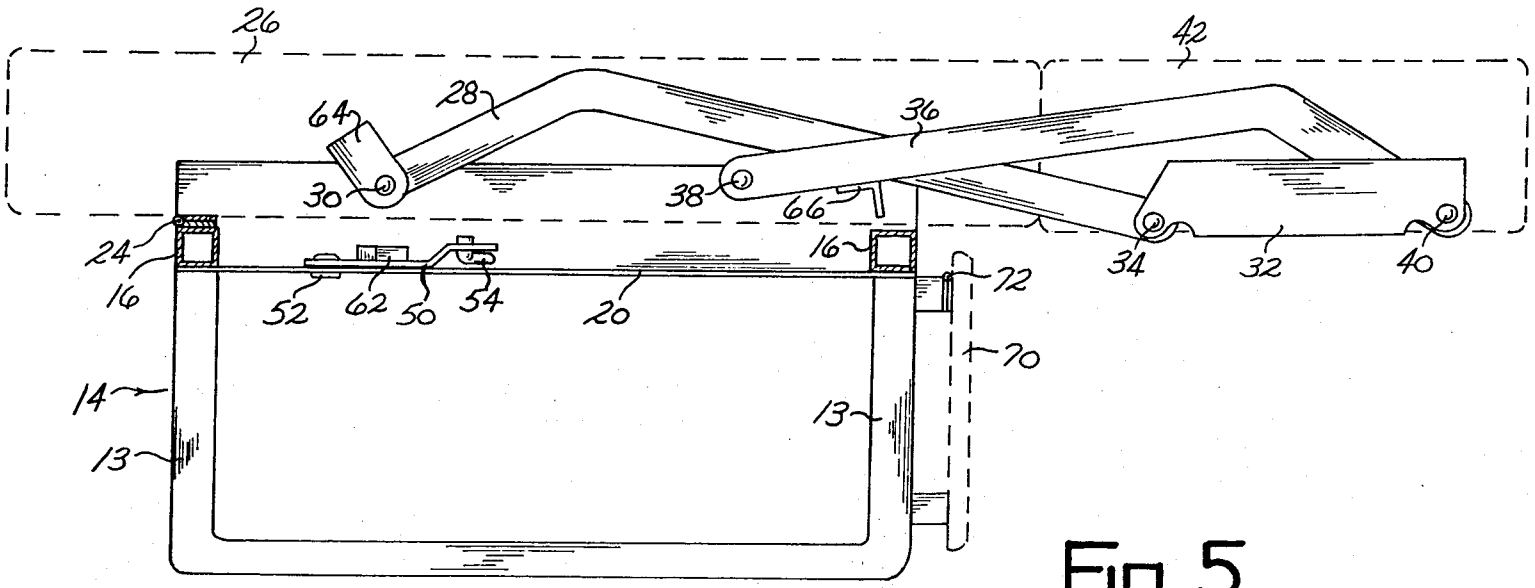
FIG. 5 is a sectional view showing the sofa-bed in its bed position with the cushions in broken lines for illustrative purposes.
Figure 7:
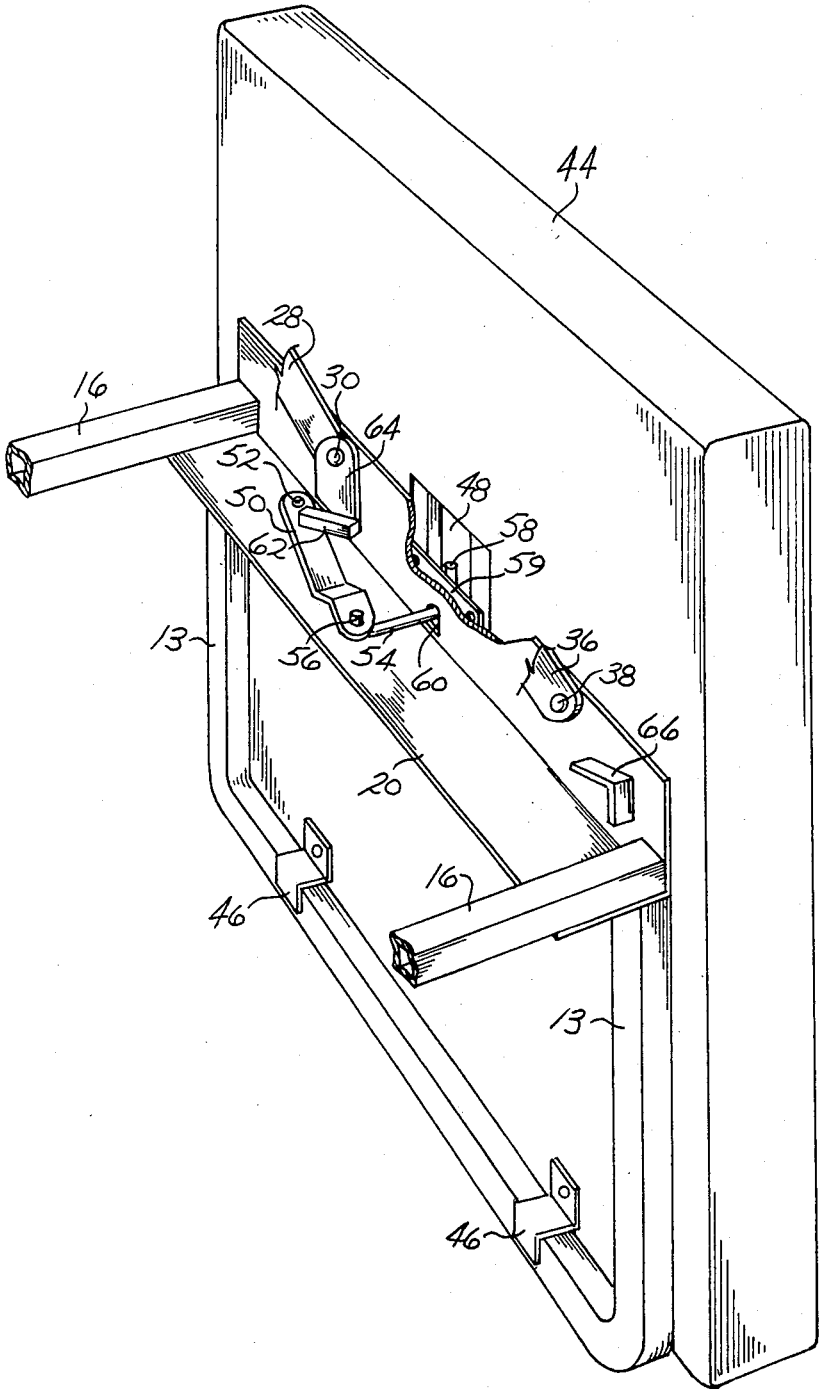
FIG. 7 is a fragmentary perspective view of the back rest linkage and arm wedge member shown in the engaged position.

To convert sofa-bed 10 from its sofa position of FIGS. 1 and 3 to its bed position of FIG. 5, one pivots back support 32 and back cushion 42 in the direction shown by arrows 68 in FIGS. 2 and 4 until the back cushion 42 and seat cushion 26 assume a horizontal inclination as shown in FIG. 5. To restore sofa-bed 10 to its sofa position, back cushion 42 is pivoted about links 28, 36 to its generally vertical sofa position shown in FIGS. 1 and 3. When sofa-bed 10 is in its sofa position, link 64 engages wedge member 62 which causes pivot member 50 to be held inwardly and arm 44 to be pulled and held by rod 54 in a vertical position as best seen in FIG. 7.

Figure 8:
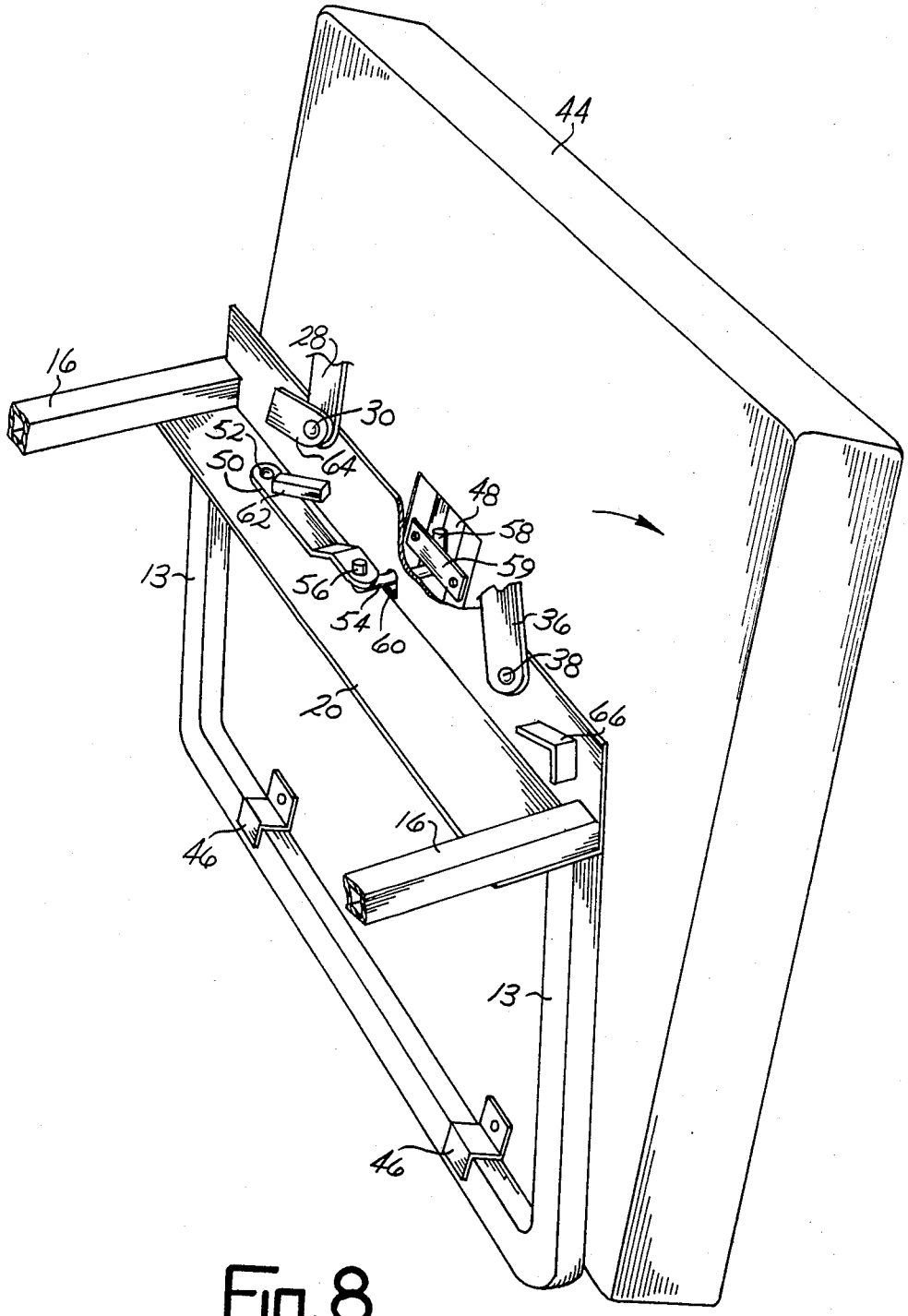
FIG. 8 is a view similar to FIG. 5 showing the linkage in a disengaged position.

As sofa-bed 10 is converted into its bed position, links 28 and 36 pivot forwardly, causing link 64 to lose contact with wedge member 62, as seen in FIG. 8. Arm 44 is then released from the pull of rod 54 and swings outwardly by gravity about hinges or pivots 46 to allow unrestricted pivoting movement of back cushion 42. When sofa-bed 10 is returned to its sofa position, link 64 contacts or cams wedge member 62 and causes pivot member 50 and rod 54 to swing inwardly and pull arm 44 inwardly due to rod 54 engaging arm stop plate 59.

Figure 6:
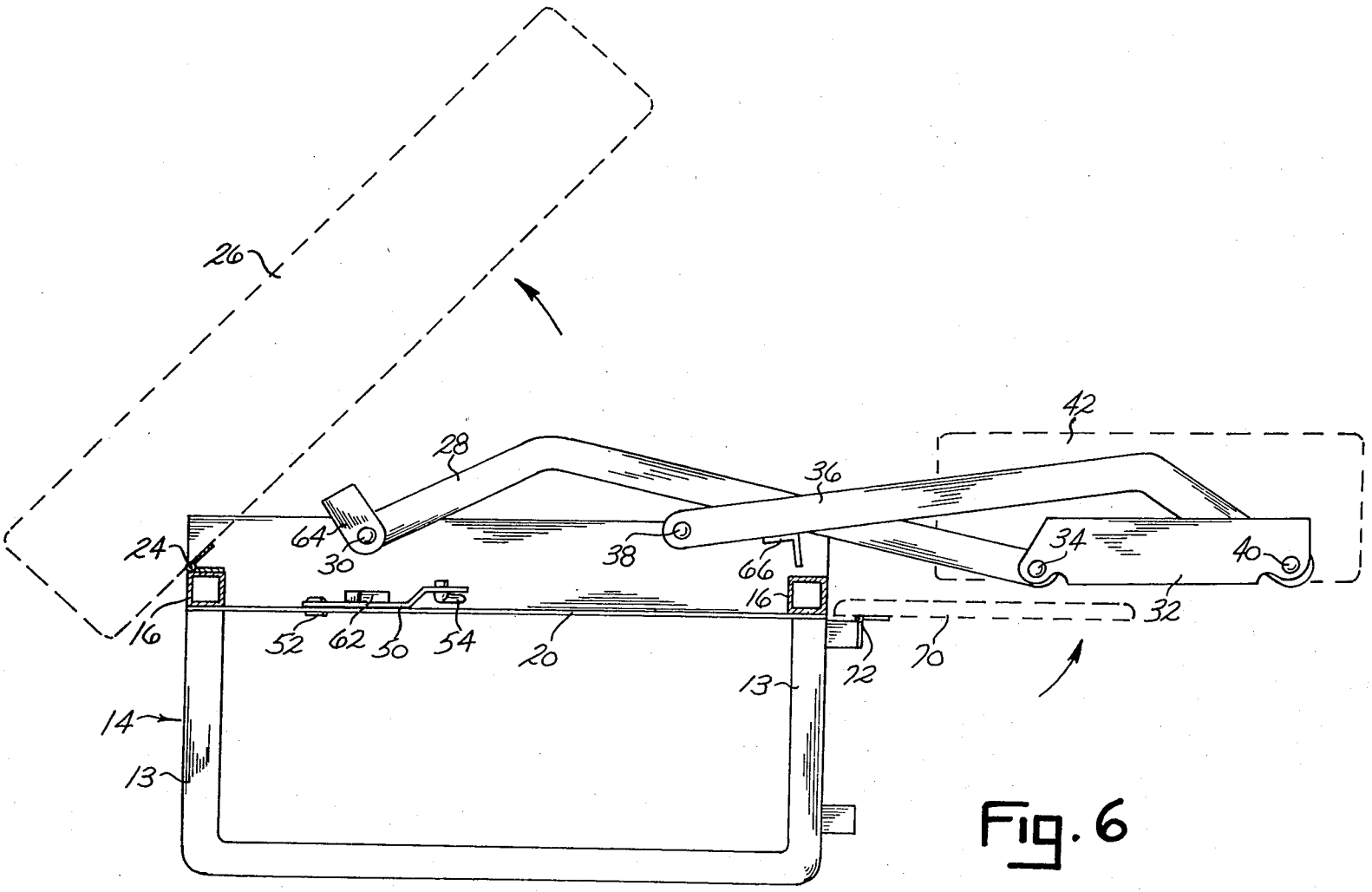
FIG. 6 is a sectional view of the bed of FIG. 5 and showing the seat cushion raised to expose a storage area.

Sofa-bed 10 may also include a front lower panel 70 which is pivotally secured by hinge 72 to each frame leg 13. As shown in FIG. 6, seat cushion 26 and panel 70 may be pivoted upwardly to expose a storage area beneath the seat cushion within base frame 12.

It is to be understood that the scope of the invention is not limited to the above-given details, but may be modified within the scope of the appended claims.

We claim:

1. In a convertible sofa-bed having a base frame which includes a generally horizontal seat, a back rest, and a pair of arms, control link means connecting said back rest to said base frame for roll-over movement of said back rest between a sofa position wherein the back rest is generally upright and a bed position wherein the back rest is forward of said seat, the improvement wherein said arms are mounted for shiftable movement outwardly of said seat, means associated with said base frame and arms responsive to said roll-over movement of the back rest for accommodating said shiftable movement of the arms outwardly of said seat, said arms hingedly connected to said base frame, said means for accommodating said arm movement including pivot means connecting said arms to said base frame, and camming means associated with said link means for contacting said pivot means upon said roll-over movement of the back rest, said pivot means upon cam means contact for allowing outward hinged movement of said arms.

2. In a convertible sofa-bed having a base frame which includes a generally horizontal seat, a back rest, and a pair of arms, control link means connecting said back rest to said base frame for roll-over movement of said back rest between a sofa position wherein the back rest is generally upright and a bed position wherein the back rest is forward of said seat, the improvement wherein said arms are mounted for shiftable movement outwardly of said seat, means associated with said base frame and arms responsive to said roll-over movement of the back rest for accommodating said shiftable movement of the arms outwardly of said seat, said means for accommodating said arm movement including a member pivotally mounted to said base frame, a rod connected at one end thereof to said member and to a said arm at its other end, and a wedge member fastened to said member wherein said roll-over movement of the back rest and said link means into said sofa position causes the link means to engage said wedge member to hold said arm in a retracted position, and said roll over movement into the bed position causes said link means to disengage said wedge member and allow said arm to move outwardly of said seat.

3. The sofa-bed of claim 2 and a front panel positioned below said seat and pivotally attached to said base frame, said panel exposing a storage area within said base frame when the panel is opened.

4. The sofa-bed of claim 3 wherein said seat is pivotally connected to said base frame whereby pivoted lifting said seat exposes said storage area.

* * * * *